US006749552B1

(12) United States Patent
Figgener et al.

(10) Patent No.: US 6,749,552 B1
(45) Date of Patent: Jun. 15, 2004

(54) SCREW-TYPE SOLID BOWL CENTRIFUGE HAVING A BAFFLE PLATE ARRANGEMENT

(75) Inventors: Helmut Figgener, Oelde (DE); Paul Brüning, Oelde (DE); Josef Von Heyden-Linden, Oelde (DE)

(73) Assignee: Westfalia Separator Industry GmbH, Oelde (DE)

( * ) Notice: Subject to any disclaimer, the term of this patent is extended or adjusted under 35 U.S.C. 154(b) by 0 days.

(21) Appl. No.: 10/129,002

(22) PCT Filed: Oct. 18, 2000

(86) PCT No.: PCT/EP00/10242

§ 371 (c)(1),
(2), (4) Date: Aug. 8, 2002

(87) PCT Pub. No.: WO01/32314

PCT Pub. Date: May 10, 2001

(30) Foreign Application Priority Data

Nov. 2, 1999 (DE) ..... 199 52 804

(51) Int. Cl.[7] ..... B04B 1/20
(52) U.S. Cl. ..... 494/53
(58) Field of Search ..... 494/37, 50–56, 494/67

(56) References Cited

U.S. PATENT DOCUMENTS 3,447,742 A * 6/1969 Eriksson ..... 494/53
3,568,919 A * 3/1971 Nielsen ..... 494/53
3,795,361 A * 3/1974 Lee ..... 494/26
4,245,777 A * 1/1981 Lavanchy ..... 494/53
4,334,647 A * 6/1982 Taylor ..... 494/37
5,156,751 A * 10/1992 Miller ..... 210/787
5,252,209 A * 10/1993 Retter ..... 210/380.3
5,474,515 A * 12/1995 Epper et al. ..... 494/9
6,572,524 B1 * 6/2003 Caldwell ..... 494/53

FOREIGN PATENT DOCUMENTS

| | | | |
|---|---|---|---|
| DE | 1 532 678 | | 3/1970 |
| DE | 2 344 507 | | 3/1974 |
| DE | 36 38 782 | A1 | 5/1988 |
| EP | 0 785 029 | A1 | 7/1997 |
| JP | 10-151369 | * | 6/1998 |
| WO | 01/32314 | A1 * | 2/2001 |

* cited by examiner

*Primary Examiner*—Charles E. Cooley
(74) *Attorney, Agent, or Firm*—Barnes & Thornburg

(57) ABSTRACT

A screw-type solid bowl centrifuge for centrifuging material which has a tendency to foam. The centrifuge includes a centrifugal drum having discharge ports and a rotatable bowl jacket with a screw that rotates relative to the bowl jacket. Also included is a feed section having a central pipe arranged concentrically about the rotation axis of a drum for feeding the material to be centrifuged through a distributor into a centrifuge chamber between the screw and the bowl jacket. The feed section is an hermitical, closed system. Further included is a baffle plate arrangement that prevents foam or certain particles from escaping from one of the discharge ports.

13 Claims, 3 Drawing Sheets

SCREW-TYPE SOLID BOWL CENTRIFUGE HAVING A BAFFLE PLATE ARRANGEMENT

BACKGROUND AND SUMMARY OF INVENTION

The invention relates to a screw-type solid bowl centrifuge for centrifuging material that has a tendency to foam.

Centrifuges in the form of screw-type solid bowl centrifuges have been known in various embodiments for a long time. A known centrifuge is illustrated in FIG. 2. When processing easily oxidizing material to be centrifuged, consisting, for example, of cut-up fruit, such as apples it is desirable to minimize as much as possible the possibility of an oxidation of the material to be centrifuged during the centrifugal treatment.

The centrifuge of the present invention addresses this problem and solves it. The centrifuge's feed section that goes through the feed pipe and the distributor into the centrifuge chamber together are designed as an essentially hermetically closed system, which in a simple manner reduces the possibility of an oxidation of the product to be centrifuged in the feed system or section of the drum. The other sections of the centrifuge may have a closed design. A hydrohermetical feed already reduces the oxidation.

According to an embodiment of the invention, the feed pipe preferably is fixedly connected with a screw by way of a distributor, so that the feed pipe rotates along with the screw during rotations of the screw. In this manner, in contrast to prior the art illustrated in FIG. 2, a "soft" preacceleration and thus a correspondingly careful treatment of the material to be centrifuged is achieved. Because the feed pipe has a rotatable design, it is, in addition, possible to connect the distributor and the feed pipe directly in a "one-piece" manner with one another without a gap or an opening, so that foam can no longer penetrate into any gaps or spaces between the feed pipe and the distributor, as was the case in the prior art.

The hygienic effect is increased by the further measure of connecting the distributor directly without a gap or an opening in circumferential openings of a screw body. This creates a free path which has no gaps or openings from the feed pipe into the centrifuge chamber of the centrifuge. In contrast to the prior art, material to be centrifuged can no longer reach the area between the outer circumference of the feed pipe and the inner circumference of the screw body because this feed section of the centrifuge is designed in a "hydrohermetically" closed manner.

According to another embodiment of the invention, the distributor has an essentially pipe-shaped construction, so that it has at least one—preferably two—radial discharge openings leading into the centrifuge chamber. The distributor may have a radial dimension such that, during the operation of the centrifuge, it projects into the liquid or under the liquid level in the centrifuge chamber, so that when its radial discharge openings are situated under the liquid level, the effect of the hermetic closing of the feed section of the centrifuge is further improved. This measure also contributes to see that a particularly careful treatment of the product/material to be centrifuged takes place.

During the processing of material to be centrifuged, in addition to a solid and a liquid phase in the centrifuge, there is a tendency to form a foam as a third phase. The foam comes from, for example, a fruit mash for producing fruit juice or a highly protein-containing material to be centrifuged. The problem arises that, in an undesired manner, the foam also exits the centrifuge through a liquid discharge port and thereby impairs the quality of the liquid phase. In the case of highly foaming products, there is also the problem that the foam contaminates the centrifuge, particularly in that it enters into gaps at the discharge of the feed pipe into the distributor and, in the worst case, virtually wells out of the centrifuge. The present invention also addresses eliminating this problem.

The present invention includes a baffle plate arrangement which is designed for preventing foam, generated during the centrifuging of material, from exiting through the liquid discharge port or through a solids discharge port.

The baffle plate arrangement has at least one or, preferably, two baffle plates which project into the liquid level one of the baffle plates preferably being arranged between the distributor and the liquid discharge port on the screw body, and the other baffle plate being arranged between the distributor and the solids discharge port on the screw body. At least one of the baffle plates projects into the liquid level and thereby forms a barrier in the direction of the corresponding discharge port for foam formed during the centrifuging of the material to be centrifuged.

According to another embodiment of the invention, at least one of the baffle plates is formed directly on the distributor and/or on the outer circumference of the screw body adjacent the distributor.

Furthermore, one of the baffle plates is preferably constructed as a solid-ring baffle without openings, and the other baffle plate is provided with openings toward its inner circumference for the passage of foam in the direction of the solids discharge port. The baffle plate located preferably between the distributor and the solids discharge port is dimensioned such that only a relatively narrow gap exists between the drum and the baffle plate. The narrow gap is designed such that a slimy solid phase can pass through it, in which case a return flow through the narrow gap is prevented by a pushing solid phase which follows.

A particularly advantageous effect is achieved by means of a combination of baffle plates and the rotatable sealed-off feed pipe, because this arrangement meets the highest hygienic requirements with respect to the feeding of material to be centrifuged as well as with respect to the foam barrier in the direction of the liquid discharge port.

Other aspects of the present invention will become apparent from the following detailed description of the invention, when considered in conjunction with accompanying drawings.

DETAILED DESCRIPTION OF THE PREFERRED EMBODIMENTS

Figure 1:
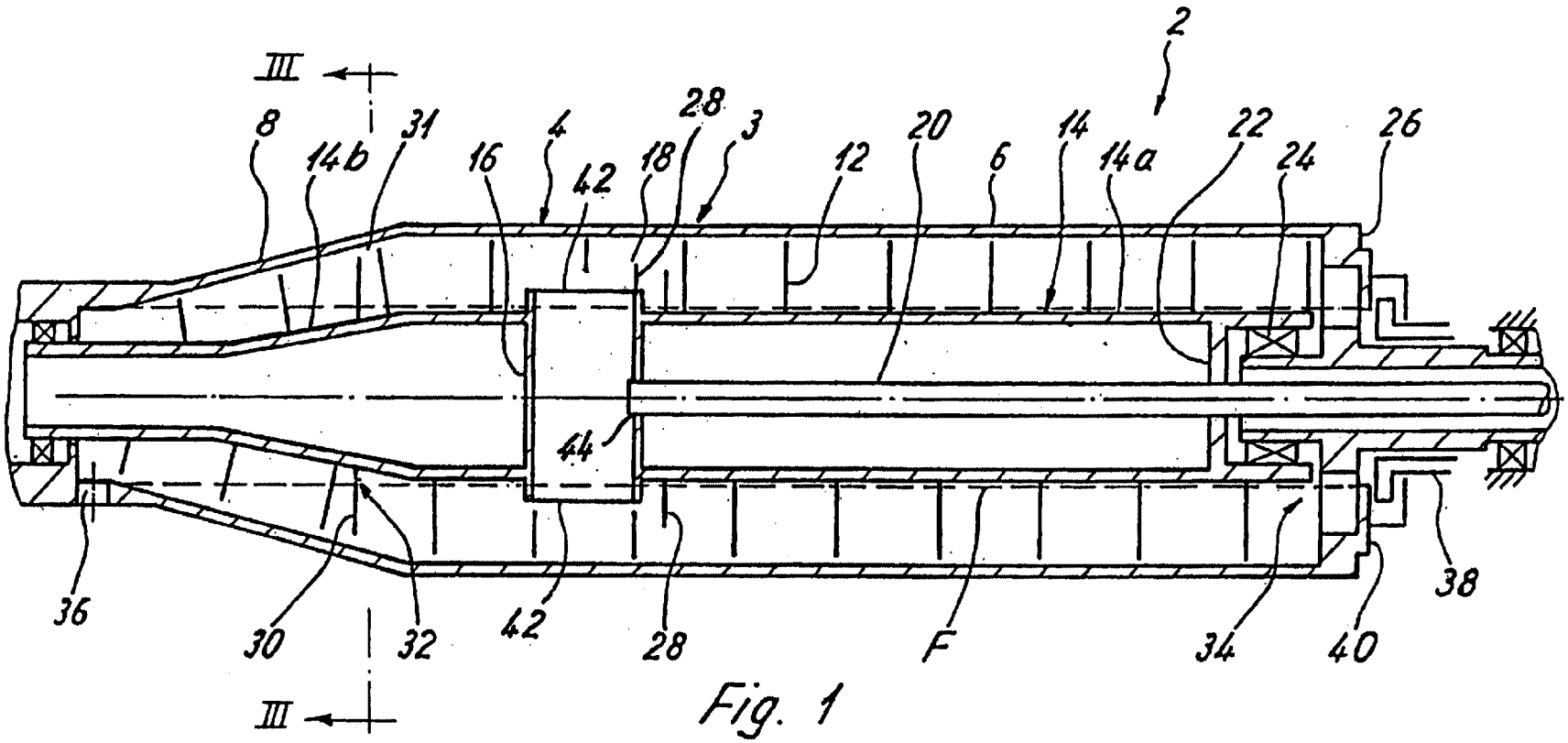
FIG. 1 is a sectional view of a centrifugal drum of a screw-type solid bowl centrifuge according to the present invention.
Figure 2:
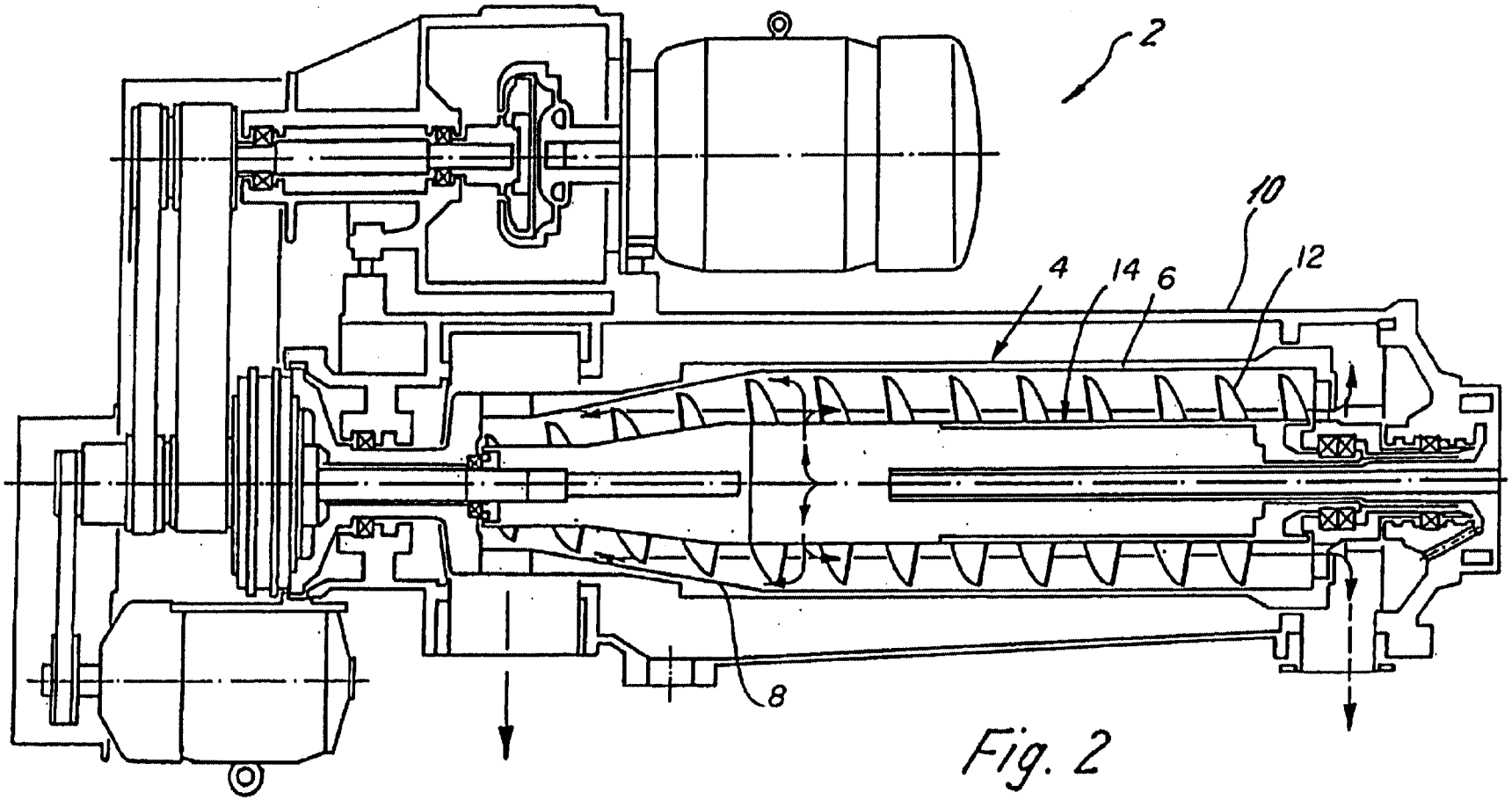
Fig. 2 PRIOR ART
FIG. 2 is a schematic representation of a screw-type solid bowl centrifuge according to the prior art.

FIG. 2 illustrates a prior art screw-type solid bowl centrifuge 2 which has a centrifugal drum 3 and an outer bowl jacket 4 which comprises a cylindrical section 6 and a conically tapering section 8 adjoining the cylindrical section 6. A rotatable screw 12 for the discharge of solids is arranged within the outer rotatable bowl jacket 4 which, according to FIG. 1, can be rotatably disposed on an outer machine frame 10.

The screw 12 has an inner, essentially cylindrical screw body 14 whose geometry is adapted essentially to the geometry of the outer centrifuge bowl jacket 4. The screw body 14 corresponds to the contour of the bowl jacket 4, and comprises a cylindrical section 14*a* as well as a conical section 14*b* adjoining the cylindrical section 14*a*. The geometry of this preferred embodiment is understood to be an example. Alternative geometries of the screw body 14, for example, purely cylindrical geometries are conceivable within the scope of the invention.

According to the present invention, at one end area of the cylindrical section 14*a*, the screw body 14 is penetrated by a distributor or pipe 16 which preferably has a rectangular cross-section and which, at its two axial ends, leads in an open manner into centrifuge chamber 18 between the screw body 14 and the bowl jacket 4 and is welded to the screw body, so that a direct, one-piece connection is established between the feed pipe 20 and the screw body 14, which connection is free of gaps and openings.

The feed pipe 20 is located in the area of the center longitudinal axis of the screw-type centrifuge. At an end facing away from the distributor 16, the feed pipe 20 is connected by way of a ring 22 to the inner circumference of the screw body 14. The screw body 14 is rotatable by means of roller bearings 24, and is disposed on a projection of the axial lid 26 which closes off the bowl jacket 4 axially. At an end facing away from the lid 26, the feed pipe 20 penetrates an opening 44 in the distributor 16. Also, the rotatable feed pipe 20 is connected (for example, welded) to the distributor 16 such that a gap-free connection is established between these elements and no material to be centrifuged or foam can enter into any gaps at that connection. The feed pipe 20 projects from the right (when viewing FIG. 1) or from the cylindrical section 14*a* of the centrifuge into the distributor 16. A reverse arrangement of the feed pipe 20 from the left or conical side 14*b* of the drum 4 is conceivable.

Figure 3:
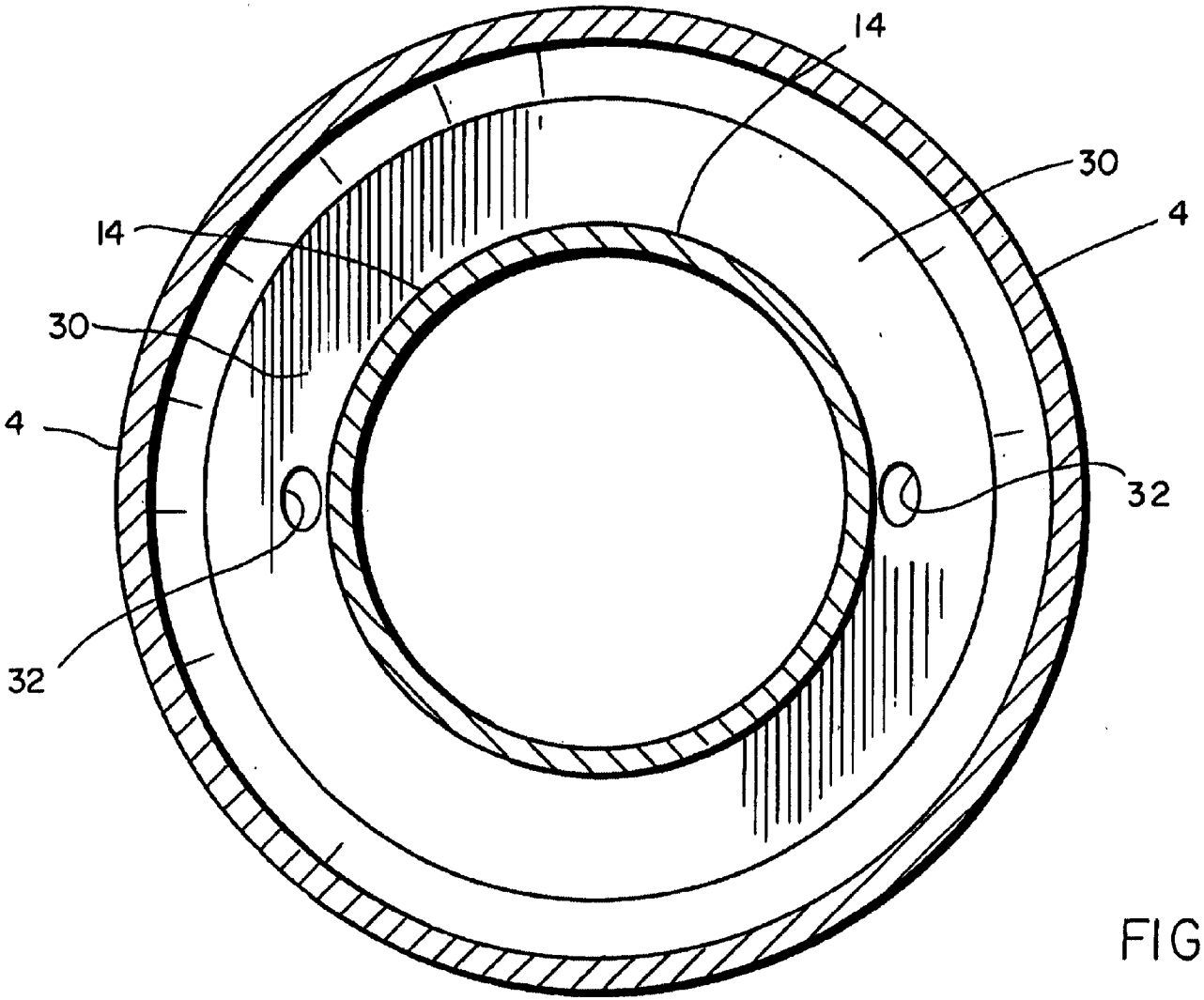
FIG. 3 is a cross-sectional view along the line III—III in FIG. 1.

Further, according to the present invention on the outer circumference of the screw body 14, a baffle plate arrangement is constructed. The baffle arrangement consists of two baffle plates 28, 30. Baffle plate 28 is located between the distributor 16 and the liquid discharge port 34, on the cylindrical section 14*a* of the screw body 14. Baffle plate 30 is located between the distributor 16 and the solids discharge port 36, on the conical section 14*b* of the screw body 14. Both baffle plates 28, 30 have such a radial dimension that, during the operation of the screw-type centrifuge, they project into the liquid level F. The baffle plate 28 connected to the cylindrical section 14*a* of the screw body 14 is constructed as a ring plate without openings, while baffle plate 30 is connected to the conical section 14*b* of the screw body 14 and has openings 32 (see FIG. 3), for example, of a slot-type or of another contour, toward its inner circumference. The radial dimension of baffle plate 30 is larger than that of baffle plate 28 in the cylindrical area of the screw body 14. Baffle plate 30 is dimensioned such that only a relatively narrow gap 31 remains between the bowl jacket 4 and baffle plate 30.

The screw-type centrifuge of the present invention generally operates as follows:

A material to be centrifuged, which may have a tendency to foam (for example, a mash of cut-up apples, from which apple juice is to be obtained) enters through the rotating feed pipe 20 into and through the distributor 16 and then into the centrifuge chamber 18. The feed pipe 20 is designed to be rotatable. The end of the pipe 20 pointing to the distributor 16 is connected (for example, by welding) in an opening of the distributor 16, and because, the distributor 16 is connected to the screw body 14 without any gaps or openings, no foam can penetrate into any openings and contaminate the centrifuge 2. A hermetically closed feed section is formed from the feed pipe 20 through the distributor 16 into the centrifuge chamber 18. This hermetic effect is intensified in that the radial discharge openings 42 (situated radially with respect to the feed pipe 20 and axially in the direction of the distributor 16) of the distributor 16, formed here as a rectangular pipe, projects into the liquid level F so that the inflowing material to be centrifuged, when entering into the centrifuge chamber 18, also cannot come in contact with air, which reduces the oxidation of the entering material to be centrifuged. In addition, the rotating feed pipe 20 has the advantage that the entering material to be centrifuged is "preaccelerated" in the feed pipe 20 which, in turn, results in a particularly careful treatment of the material to be centrifuged.

Baffle plate 28, which projects into the liquid level F, prevents the exiting of foam through the liquid discharge port 34 which further improves the quality of the liquid phase. The foam can, on the contrary, exit from the centrifuge 2 through slot-type openings 32 in the baffle plate 30 and then through the solid discharge port 36. The baffle plate 30 also has the purpose of preventing the return flow of a slimy solid phase back through the narrow gap 31 into the cylindrical section 8 of the drum 3. In this case, the openings 32 in baffle plate 30 permit the exiting of the foam in the direction of the solids discharge port 36 which, if baffle plate 30 had a closed design, could not escape from the drum 3 without the openings 32.

The liquid level F is determined at the liquid discharge port 34, where the liquid is discharged through a rotary cutting tube 38, adjacent an inner circumference of upper baffle plate 40. As shown in FIG. 1, the liquid level F reaches almost to the screw body 14.

In the present invention, an impairment of the quality of the liquid phase (for example, apple juice) as a result of oxidation and/or foam is prevented without significant expenditures while a particularly high hygienic standard is ensured.

Although the present invention has been described and illustrated in detail, it is to be clearly understood that this is done by way of illustration and example only and is not to be taken by way of limitation. The spirit and scope of the present invention are to be limited only by the terms of the appended claims.

What is claimed is:

1. A screw-type solid bowl centrifuge for centrifuging material which has a tendency to foam, the centrifuge comprising:

a centrifugal drum having a liquid discharge port, a solids discharge port and a rotatable cylindrical-conical bowl jacket having a screw which is rotatable relative to the bowl jacket;

a feed section having a central feed pipe arranged concentrically about the axis of rotation of a centrifugal drum for the feeding of the material to be centrifuged through a distributor into a centrifuge chamber between the screw and the bowl jacket, wherein the feed section is an hermetical, closed system;

a screw body; and a baffle plate arrangement for preventing foam or small or floating particles formed during centrifuging from being discharged through the liquid discharge port, wherein the baffle plate arrangement has two baffle plates with one baffle plate located on the screw body between the distributor and the liquid discharge port and the other baffle plate located on the screw body between the distributor and the solids discharge port and the latter baffle plate having openings toward its inner circumference for the passage of foam in the direction of the solids discharge port.

2. The screw-type solid bowl centrifuge according to claim 1, wherein the feed pipe is fixedly connected with the screw so that, during rotations of the screw, the feed pipe rotates along with the screw.

3. The screw-type solid bowl centrifuge according to claim 2, wherein an end of the feed pipe is directly connected with the distributor without any gaps.

4. The screw-type solid bowl centrifuge according to claim 3, wherein the distributor is directly connected without gaps to circumferential openings of the screw body.

5. The screw-type solid bowl centrifuge according to claim 1, wherein the distributor has a pipe-type construction.

6. The screw-type solid bowl centrifuge according to claim 1, wherein the distributor has at least one radial discharge opening leading into the centrifuge chamber.

7. The screw-type solid bowl centrifuge according to claim 6, wherein the distributor has a radial dimension such that, during operation of the centrifuge, the distributor extends below a liquid level in the centrifuge chamber, such that the at least one radial discharge opening is situated below the liquid level.

8. The screw-type solid bowl centrifuge according to claim 7, wherein the radial dimension of the baffle plate located between the solids discharge port and the distributor is larger than that of the baffle plate located between the liquid discharge port and the distributor.

9. The screw-type solid bowl centrifuge according to claim 1, wherein the baffle plate arrangement has at least one baffle plate which projects into a liquid level in the centrifuge chamber and the at least one baffle plate is located between the distributor and one of the discharge ports.

10. The screw-type solid bowl centrifuge according to claim 1, wherein at least one of the baffle plates is located on a conical section of the screw body.

11. The screw-type solid bowl centrifuge according to claim 1, wherein at least one of the baffle plates located on the screw body is constructed as a solid ring disk without openings.

12. The screw-type solid bowl centrifuge according to claim 1, wherein the baffle plate located between the distributor and the solids discharge port is dimensioned so that a narrow gap exists between this baffle plate and the bowl jacket such that a slimy solid phase can pass through the narrow gap and any return flow through the narrow gap is prevented by a pushing solid phase which follows.

13. The screw-type solid bowl centrifuge according to claim 1, wherein at least one of the baffle plates is formed directly on the distributor.

* * * * *